United States Patent [19]

Matsui et al.

[11] Patent Number: 4,553,708

[45] Date of Patent: Nov. 19, 1985

[54] DEFECTIVE PACKAGE SELECTOR FOR WINDERS

[75] Inventors: Isamu Matsui, Kyoto; Yutaka Ueda, Nara, both of Japan

[73] Assignee: Murata Kikai Kabushiki Kaisha, Japan

[21] Appl. No.: 438,333

[22] Filed: Nov. 1, 1982

[30] Foreign Application Priority Data

Nov. 2, 1981 [JP] Japan ..... 56-175889

[51] Int. Cl.[4] ..... B65H 63/02

[52] U.S. Cl. ..... 242/36; 242/35.5 A; 242/35.6 R; 209/927

[58] Field of Search ..... 242/36, 37 R, 35.5 R, 242/35.6 R, 35.5 A; 57/264, 265; 377/16; 209/927

[56] References Cited

FOREIGN PATENT DOCUMENTS 2061333 5/1981 United Kingdom ..... 242/36

*Primary Examiner*—Stanley N. Gilreath

*Attorney, Agent, or Firm*—Spensley, Horn, Jubas & Lubitz

[57] ABSTRACT

The number of yarn knots while a package is being wound is detected and stored, and compared with a preset number of yarn knots for a single package. When the stored number of yarn knots is greater than the preset number, a signal is produced which is indicative of a defective package. The defective package is sorted out and discharged on a conveyor by a processing unit under the control of the produced signal.

4 Claims, 1 Drawing Figure

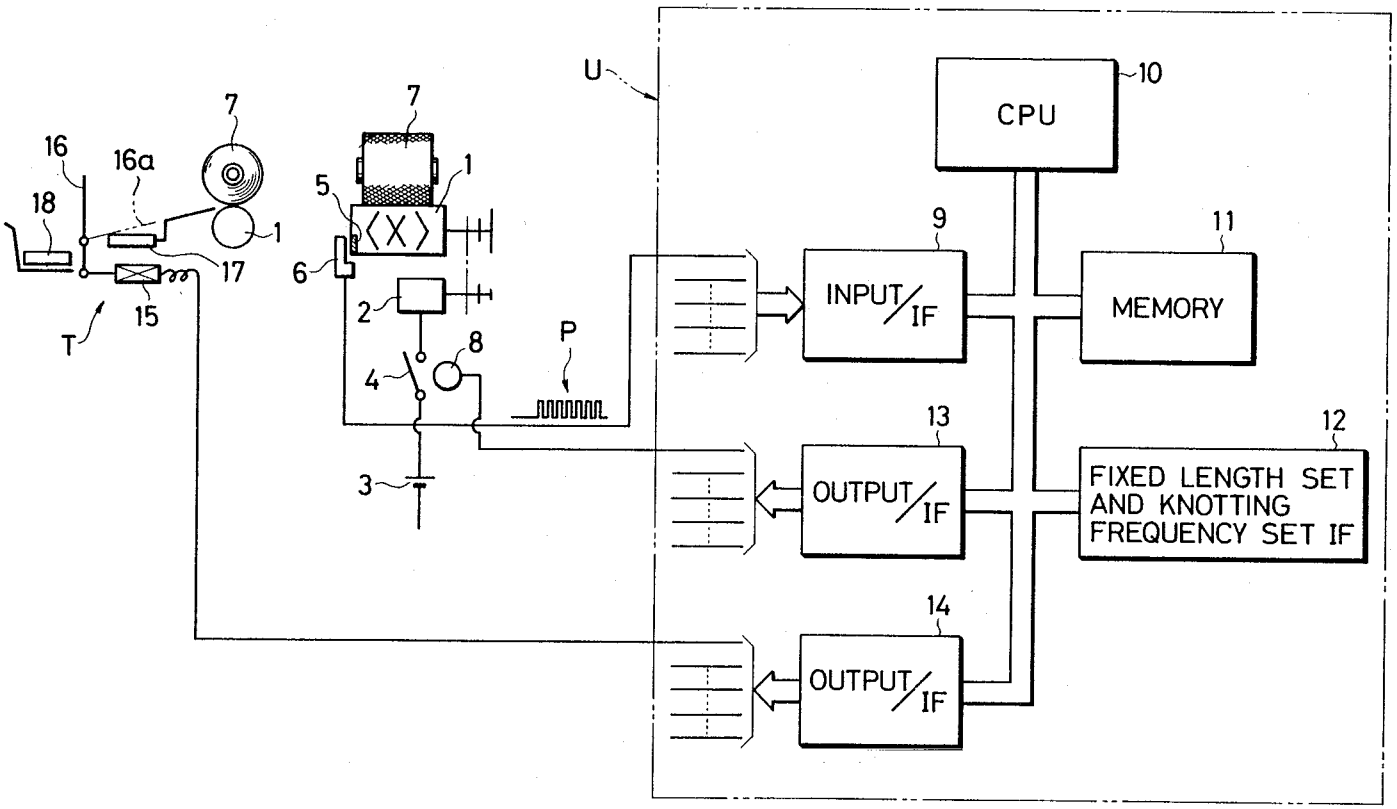
CPU
10
MEMORY
11
FIXED LENGTH SET AND KNOTTING FREQUENCY SET IF
12
INPUT/IF
9
OUTPUT/IF
13
OUTPUT/IF
14
U
P
1
2
3
4
5
6
7
8
16
16a
17
18
15
T

DEFECTIVE PACKAGE SELECTOR FOR WINDERS

BACKGROUND OF THE INVENTION

The present invention relates to a defective package selector for use in a winder.

While a yarn is being wound in a winder, yarn defects such as slubbing and thin yarn are generally detected by a slub catcher in the winder and severed to remove such yarn defects. Then, the cut yarn ends are knotted together for starting to wind the yarn again.

Where a yarn supplied has too many defects, particularly those defects large enough to be detected by the slub catcher, the yarn has to be cut off many times and the number of yarn knots that should be made increases of necessity.

When a package with a certain amount of yarn wound has too many yarn knots and is used as a yarn supply for a knitting machine or loom, such yarn knots tend to be frequently caught and cut off in the knitting machine or loom, and many yarn ends need to be knotted together in a tedius and time-consuming procedure. Furthermore, too many yarn knots mean a poor quality of yarn on such a package. Stated otherwise, the presence of a large number of yarn defects as detected by the slub catcher justifies the presumption that there may be a lot greater number of yarn deficiencies which cannot be detected by the slub catcher.

SUMMARY OF THE INVENTION

It is an object of the present invention to provide an apparatus for selecting a package of yarn of poor quality.

According to the present invention, the number of yarn knots in a winder is detected using a pulse signal generated on yarn winding in the winder for a fixed yarn length or quantity. When the number of yarn knots as detected is greater than a preset number of yarn knots for a single package wound up, the package is determined as a defective package, which is delivered in a route different from that for normal packages or is provided with a marking so as to be separated from normal packages that will consecutively be processed in subsequent processing steps.

The above and other objects, features and advantages of the present invention will become more apparent from the following description when taken in conjunction with the accompanying drawing in which a preferred embodiment of the present invention is shown by way of illustrative example.

BRIEF DESCRIPTION OF THE DRAWING

The sole FIG. is a schematic diagram, partly in block form, of a defective package selector according to the present invention.

DETAILED DESCRIPTION

As shown in the single FIG., a winding drum 1 is driven by a motor 2 energizable by a switch 4 connected to a power supply 3. The switch 4 remains closed to energize while a yarn is normally wound. Upon detection of a yarn breakage, however, the switch 4 is opened to de-energize the motor 2, whereupon the winding drum 1 is brought to a halt to stop the yarn winding. The winding drum 1 has a magnet 5 embedded in an end thereof. A sensor 6 is positioned closely to the magnet 5 for producing a pulse in response to magnetic forces of the magnet 5 each time the drum 1 makes one revolution. A yarn package 7 is held against the winding drum 1. A relay 8 serves to stop the rotation of the winding drum 1 when a doffing signal is generated.

A pulse signal P generated by the sensor 6 is delivered to an arithmetic unit 10 through a drum rotation input interface 9 in a defective package selector control unit U. The arithmetic unit CPU is connected to a memory unit 11 for storing a program for controlling the control unit, data on yarn length and other data, and an interface 12 for supplying signals indicative of yarn length setting and display and also setting and display control signals indicative of upper limits for the number of yarn knots. The control unit U also includes an interface 13 for issuing a command signal to stop a drum for a fixed yarn length, and an interface 14 for issuing a command signal for selecting a defective package produced.

The command signal from the interface 14 is supplied to a defective package selector solenoid 15 for actuating a guide plate 16. A defective package processing unit T includes a normal package conveyor 17 and a defective package conveyor 18 extending along the winder, the guide plate 16 being swingably interposed between the conveyors 17, 18 and operatively coupled to the solenoid 17. When the guide plate 16 is in the solid-line position, a doffed package is delivered onto and transferred by the conveyor 17. When the solenoid 15 is energized to displace the guide plate 16 to the two-dot-and-dash-line position **16*a*, a package falls down the guide plate 16*a* onto the defective package conveyor 18** and is discharged out.

Operation of the defective package selector thus constructed is as follows:

The number of yarn knots occasioned while a certain amount of yarn is wound up is stored in the memory. The stored number of yarn knots on a doffed package is compared with a preset number. When the stored number exceeds the preset number, the doffed package is determined as being defective.

The number of yarn knots can be determined as follows: During normal yarn winding operation, the magnet 5 is periodically brought into proximity with the sensor 6 while the winding drum 1 is rotating. Pulses which are generated by the sensor 6 are supplied through the interface 9 to the arithmetic unit 10, in which the supplied pulses are counted to measure the length of yarn wound.

When the yarn being wound is broken, the winding drum 1 is stopped by a relay (not shown), and the yarn ends are automatically knotted together. During such yarn knotting operation, the winding drum 1 is held at rest and no pulse is generated from the sensor 6. The arithmetic unit 10 determines that yarn knotting is being carried out unless it receives a pulse signal in at least a predetermined interval of time, and stores a single pulse into the memory 11 to memorize the number of yarn knots. By setting the above predetermined interval of time as a time period shorter than it takes for effecting a single yarn knotting operation, the memory 11 is supplied with one pulse even when the first yarn knotting is unsuccessful and the consecutive second yarn knotting is successful. Therefore, each time a yarn knot is made, the memory 11 is supplied with a single pulse, and the memory 11 thus stores an accumulated number of yarn knots.

When the number of pulses generated by the sensor 6 during yarn winding operation reaches a predetermined number, that is, the yarn of a fixed length preset in the interface 12, the arithmetic unit 10 compares the actual number N of yarn knots which is stored in the memory 11 with a preset upper limit n for yarn knots. When $N \geqq n$, the package being wound is determined as being defective by the arithmetic unit 10, which then enables the interface 14 to actuate the solenoid 15.

In response to the predetermined number of pulses supplied to the arithmetic unit 10, the latter causes the doffing command interface 13 to energize the relay 8, whereupon the switch 4 is turned off to de-energize the motor 2 for thereby stopping the drum 1.

When the solenoid 15 is energized by the interface 14 for defective package selection, the guide plate 16 is turned to the position **16*a* to allow the defective package to be discharged onto the defective package conveyor 18. The doffing device may have a unit for putting a marking on the defective package in response to an output from the interface 14**, an arrangement which permits one conveyor to be employed for conveying both normal and defective packages.

While in the illustrated embodiment the defective package selector U uses a computer, it can utilize a variety of other devices for detecting the number of yarn knots. Although the defective package selecting and processing unit T has been shown as using selectable package conveyors, only a single conveyor may be employed and means may be utilized for providing yarn ends of packages with markings of colors different from that of the yarn layer so that the packages can be sorted out at a later processing step.

According to the present invention, as described above, a defective package selector has a defective package selector control unit for detecting the number of yarn knots based on a pulse signal generated on yarn winding for a fixed yarn length, comparing the actual yarn knots with a preset number of yarn knots for a single package when a certain amount of yarn is wound up, and for determining the package as being defective when the actual number of yarn knots is larger than the preset number, and a processing unit responsive to an output from the defective package selector control unit for treating the doffed package as a defective package. The number of yarn knots can be measured on the basis of a signal utilized for normal fixed yarn length winding without having to provide a sensor for detecting the number of yarn knots for each winding unit. The quality of yarn on a doffed package can easily be evaluated without having to resort to the skill of an operator for package selection.

Although a certain preferred embodiment has been shown and described, it should be understood that many changes and modifications may be made therein without departing from the scope of the appended claims.

What is claimed is:

1. A defective package selector for a yarn winding apparatus, the apparatus of the type having a rotating yarn package being wound with a fixed, predetermined length of yarn, the selector comprising:

pulse signal producing means for producing a pulse signal in response to detection of a knotting operation, the pulse signal producing means including a rotatable body contacting the rotating yarn package and sensor means for generating a pulse signal each time the rotatable body makes a revolution, a defective package selector control unit for receiving the pulse signals generated by the sensor means and determining and storing a value representing the number of yarn knots on the package being wound based on the number of pulse signals generated during yarn winding on the package, comparing the stored value of the number of yarn knots on the package with a preset number of yarn knots per the predetermined length of yarn, and producing a defective package signal when the stored value of the number of yarn knots on the package exceeds the preset number of yarn knots, and a processing unit responsive to the defective package signal from said control unit for sorting out and processing doffed packages separately as normal and defective packages.

2. A defective package selector as claimed in claim 1, wherein said defective package selector control unit is a computer.

3. A defective package selector as claimed in claim 1, wherein said processing unit comprises:

a solenoid being energizable in response to the defective package signal, a normal package conveyor, a defective package conveyor extending along the winder, and a guide plate being swingably interposed between the normal package conveyor and the defective package conveyor, said guide plate being operatively coupled to the solenoid and being swung to a position that allows the defective package to be discharged onto the defective package conveyor when the solenoid is energized.

4. In a yarn-winding apparatus having a splicing device for splicing yarn thereby producing yarn knots, an apparatus for detecting defective yarn packages having more than a desired maximum number of yarn knots and separating the detected defective yarn packages from normal yarn packages having a number of yarn knots therein less than or equal to the desired maximum number of yarn knots, the detecting and separating apparatus comprising:

separating means for separating defective yarn packages from normal yarn packages; and detection means for detecting defective yarn packages, the detection means controlling operation of the separating means, wherein the detection means includes:

a cylindrical winding body rotatable about a central longitudinal axis, the cylindrical body rotating fully about the axis in a period of time less than the time period for completing a splicing operation;

means for stopping the rotation of the winding body prior to the beginning of a splicing operation and for starting the rotation of the winding body after completion of the splicing operation;

means for emitting a knot signal when the stopping means causes the winding body to stop rotating for a period of time in excess of the winding body rotation time period;

means for counting the number of knot signals emitted for the particular yarn package being wound; and means for emitting a defective yarn package signal when the counted number of emitted knot signals exceeds a predetermined number equal to the desired maximum number of yarn knots.

* * * * *